US008375589B2

(12) United States Patent
Bremer et al.

(10) Patent No.: US 8,375,589 B2
(45) Date of Patent: Feb. 19, 2013

(54) FOLDING KNIFE

(75) Inventors: Rodney L. Bremer, Wilsonville, OR (US); Douglas B. Flagg, West Linn, OR (US); Tong Chiu, Taichung Hsien (TW)

(73) Assignee: GBII Corporation, Wilsonville, OR (US)

( * ) Notice: Subject to any disclaimer, the term of this patent is extended or adjusted under 35 U.S.C. 154(b) by 687 days.

(21) Appl. No.: 12/070,026

(22) Filed: Feb. 13, 2008

(65) Prior Publication Data

US 2008/0201953 A1 Aug. 28, 2008

Related U.S. Application Data

(60) Provisional application No. 60/901,527, filed on Feb. 14, 2007.

(51) Int. Cl.
*B26B 1/04* (2006.01)

(52) U.S. Cl. ..... 30/155; 30/160; 30/161

(58) Field of Classification Search ..... 30/160, 30/161, 159, 155, 157
See application file for complete search history.

(56) References Cited

U.S. PATENT DOCUMENTS 5,331,741 A * 7/1994 Taylor, Jr. ..... 30/158
5,822,866 A * 10/1998 Pardue ..... 30/161
6,810,588 B1 * 11/2004 Cheng ..... 30/153
6,941,661 B2 * 9/2005 Frazer ..... 30/160
7,146,736 B1 * 12/2006 Collins ..... 30/160
7,243,430 B1 * 7/2007 Lerch ..... 30/160
7,275,321 B2 * 10/2007 Cheng ..... 30/160
7,278,213 B2 * 10/2007 Pardue et al. ..... 30/160
7,302,760 B2 * 12/2007 Lake ..... 30/161
7,313,866 B2 * 1/2008 Linn et al. ..... 30/159
7,437,822 B2 * 10/2008 Flagg et al. ..... 30/161
7,458,159 B2 * 12/2008 Galyean et al. ..... 30/160
7,536,788 B2 * 5/2009 VanHoy et al. ..... 30/154
7,555,839 B2 * 7/2009 Koelewyn ..... 30/160
7,676,932 B2 * 3/2010 Grice et al. ..... 30/160
2005/0144788 A1 7/2005 Lake

* cited by examiner

*Primary Examiner* — Andrea Wellington
*Assistant Examiner* — Omar Flores Sanchez
(74) *Attorney, Agent, or Firm* — Klarquist Sparkman, LLP

(57) ABSTRACT

A folding knife in exemplary embodimentsTong comprises a handle portion, a blade, a locking cross-bolt, and a motion limiting member coupled to the handle. When the blade is in the closed position, the motion limiting member is in a first position that prevents the cross-bolt from moving to its locked position. When pivoting the blade to the open position, the motion limiting member moves to a second position that does not prevent the cross-bolt from moving to its locked position. A biased safety mechanism can also be used to block the cross-bolt from moving to an unlocked position.

14 Claims, 9 Drawing Sheets

FOLDING KNIFE

CROSS REFERENCE TO RELATED APPLICATION

This application claims the benefit of U.S. Provisional Patent Application Ser. No. 60/901,527 filed Feb. 14, 2007.

BACKGROUND

The present disclosure concerns embodiments of a folding knife.

DESCRIPTION OF THE RELATED ART

A folding knife is a knife with a blade that pivots about a point, thereby allowing the blade to fold into the handle. Folding knives can be either manual or automatic. A manual folding knife typically has a thumb stud or other grasping mechanism to permit the user to easily move the blade from a closed position to an open position. On the other hand, automatic knives use some type of stored energy to force the blade into an open position upon release of the stored energy. Folding knives, both manual and automatic, can also include a mechanism to hold the blade in an open position. For example, some folding knives have a slip joint that hold the blade in the open position until a certain amount of pressure is applied to the blade. Other knives use a lockback or spine lock to maintain the blade in an open position until a particular release mechanism is applied.

SUMMARY

The present invention is directed toward new and non-obvious aspects and features of a folding knife, both alone and in various combinations and sub-combinations with one another, which are set forth in the claims below. Unique and non-obvious methods for converting a folding knife from an automatic knife to a manual knife, and vice versa, are also disclosed herein.

The folding knife, according to one embodiment, comprises a handle portion, a blade, a cross-bolt, and a motion limiting member coupled to the handle. The blade has a tang portion that is pivotably coupled to the handle portion and is operable to pivot between a closed position and an open position. The cross-bolt is disposed in the handle portion and has an operating button exposed at one side of the handle portion. The cross-bolt is moveable between an unlocked position and a locked position to retain the blade in the open position. The folding knife is configured such that when the blade is in the closed position, the motion limiting member is in a first position that prevents the cross-bolt from moving to its locked position. When pivoting the blade to the open position, however, the motion limiting member moves to a second position that does not prevent the cross-bolt from moving to its locked position. In this manner, the cross-bolt effectively locks the blade in the open position but does not lock the blade in the closed position.

Additionally, the motion limiting member can include an end portion that is resiliently biased against the tang portion of the blade, such that the end portion slidably contacts the tang portion when the blade is moved from the closed position to the open position. The motion limiting member can further comprise a spring arm with a fixed portion and an end portion, where the end portion is resiliently biased against an end surface of the tang portion of the blade and the fixed portion is fixed to the handle portion to prevent relative motion between the fixed portion and the handle portion. The fixed portion can also be fixedly attached to a spacer that is in turn secured between two opposing plates of the handle portion. In the blade closed position, the end portion of the spring arm contacts the cross-bolt, preventing it from moving to the locked position. When the blade is pivoted open, the end portion is moved away from the path of the cross-bolt, allowing it to move to the locked position for retaining the blade open.

Additionally, the folding knife can also comprise a safety mechanism moveable between a release position and a safety position, and a biasing mechanism configured to resiliently urge the safety mechanism to the safety position. The safety mechanism can be configured such that when it is in the safety position, it blocks the cross-bolt from moving to the unlocked position (thus preventing inadvertent activation of the cross-bolt), and when it is in the release position, the cross-bolt can be moved to the unlocked position. The biasing mechanism can comprise a wire spring having a fixed end portion and a free end portion, where the free end portion resiliently contacts the safety mechanism to urge the safety mechanism into the locked position.

Additionally, the safety mechanism can further comprise a base portion with a shoulder portion and a lever portion extending therefrom. The lever portion can have a manually operable exposed member and the shoulder portion can be configured such that, when the safety mechanism is in the locked position, the shoulder portion extends into a recess in the handle portion and prevents the cross-bolt from being moved into the unlocked position by blocking an end of the crossbolt from entering the recess. The manually operable exposed member can be located towards an end of the handle portion where the tang of the blade is pivotably coupled to the handle portion, and the manually operable exposed member can be located on a side of the handle portion that is opposite to the side on which the operating button of the cross-bolt is located.

In another embodiment, the folding knife comprises a handle portion, a blade, a cross-bolt, a safety mechanism, and a biasing mechanism. The blade has a tang portion that is pivotably coupled to the handle portion and is operable to pivot between a closed position and an open position. The cross-bolt is disposed in the handle portion and has an operating button exposed at one side of the handle portion. The cross-bolt is moveable between an unlocked position and a locked position to retain the blade in at least the open position. The safety mechanism is moveable between a release position and a safety position, wherein when the safety mechanism is in the safety position, it blocks the cross-bolt from moving to the unlocked position, and wherein when the safety mechanism is in the release position, the cross-bolt can be moved to the unlocked position. The biasing mechanism is configured to resiliently urge the safety mechanism to the safety position.

Additionally, the biasing mechanism can comprise a wire spring having a fixed end portion and a free end portion, where the free end portion resiliently contacts the safety mechanism to urge the safety mechanism into the locked position. The wire spring may also include a coil at the fixed end portion. The coil can be disposed around a projection that extends internally from the handle portion of the knife.

Additionally, the folding knife can further comprises a second biasing mechanism configured to apply a biasing force to the blade that is effective to open the blade from the closed position when the safety mechanism is moved to the release position and the cross-bolt is moved to the unlocked position. The second biasing mechanism can be a torsion spring operatively connected to the blade and the handle.

Additionally, the safety mechanism can further comprise a base portion having a shoulder portion and a lever portion extending therefrom. The lever portion can have a manually operable exposed member and the shoulder portion can be configured such that, when the safety mechanism is in the locked position, the shoulder portion extends into a recess in the handle portion and prevents the cross-bolt from being moved into the unlocked position by blocking an end of the crossbolt from entering the recess.

In yet another embodiment, a method of converting a manual folding knife into an automatic folding knife is disclosed. The manual folding knife comprises a handle portion, a blade pivotably coupled to the handle portion, a cross-bolt that is moveable between a locked position and an unlocked position, and a motion limiting member that prevents the cross-bolt from moving to its locked position when the blade is closed. The method comprises removing the motion limiting member to allow the cross-bolt to lock the blade in closed and open positions and installing a biasing member that is operable to automatically open the blade when the cross-bolt is moved to its unlocked position.

Additionally, the motion limiting member can be a spring arm having an end portion bearing against an end surface of the blade, where the spring arm is resiliently biased to a first position that blocks the cross-bolt from moving to its locked position when the blade is in the closed position, and wherein pivoting the blade to the open position moves the spring arm to a second position that allows the cross-bolt to be moved to its locked position. The biasing member that automatically opens the blade can be a torsion spring operatively connected to the blade and the handle.

In yet another embodiment, a method of converting an automatic folding knife into a manual folding knife is disclosed. The automatic folding knife comprises a handle portion, a blade pivotably coupled to the handle portion, a cross-bolt that is moveable between a locked position and an unlocked position, and a biasing member that causes the blade to automatically open when the cross-bolt is moved to its unlocked position. The method comprises installing a motion limiting member that prevents the cross-bolt from moving to its locked position when the blade is closed and removing the biasing member.

Additionally, the motion limiting member can be a spring arm having an end portion bearing against an end surface of the blade, where the spring arm is resiliently biased to a first position blocking the cross-bolt from moving to its locked position when the blade is in the closed position, and wherein pivoting the blade to the open position moves the spring arm to a second position that allows the cross-bolt to be moved to its locked position. The biasing member can be a torsion spring operatively connected to the blade and the handle.

DETAILED DESCRIPTION

Figures 1, 2, 3:
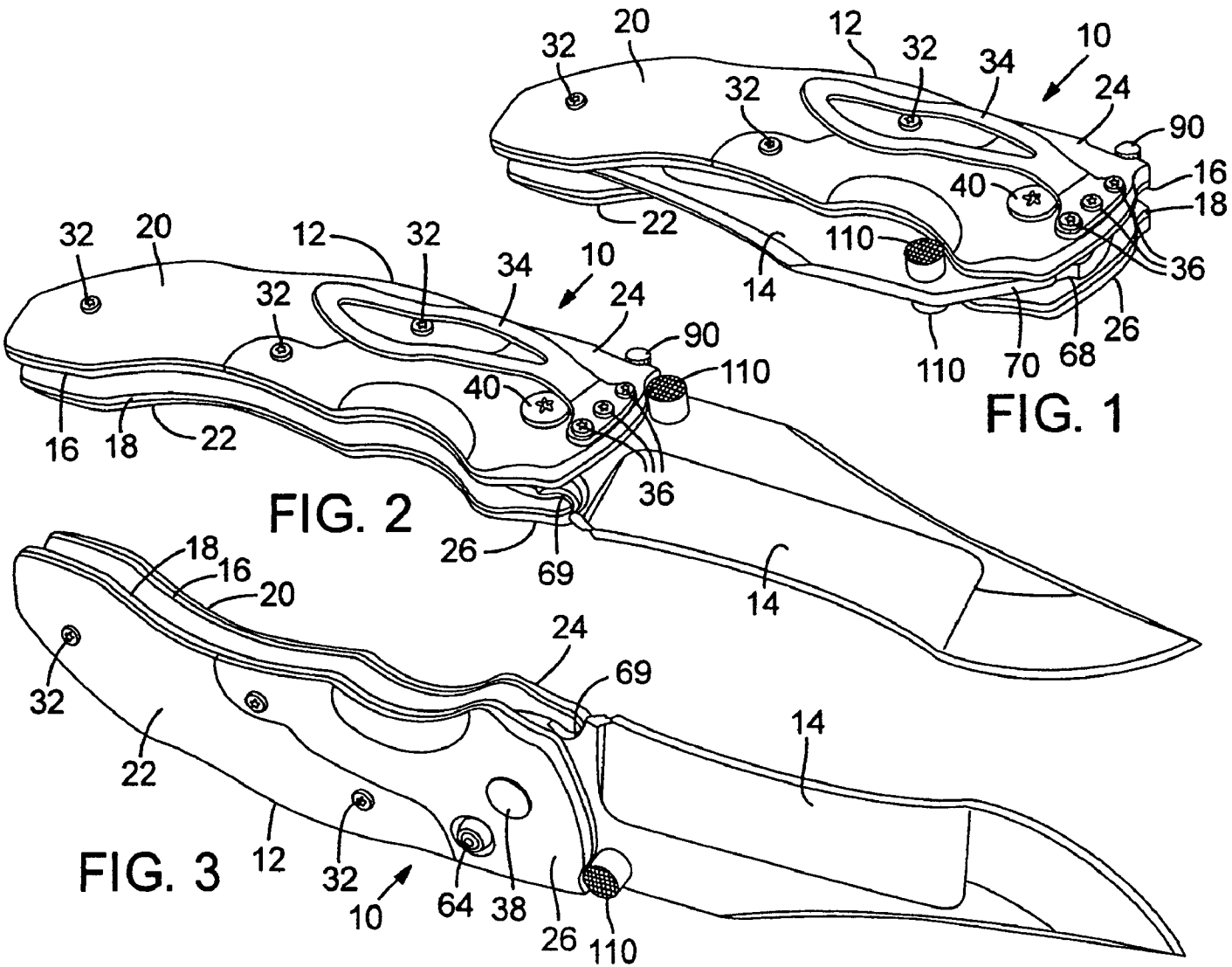
FIG. 1 is a perspective view of an exemplary embodiment of an automatic folding knife shown with the blade in the closed position.
FIG. 2 is a perspective view of the folding knife of FIG. 1 shown with the blade in the open position, as viewed from the bottom and one side of the knife.
FIG. 3 is a perspective view of the folding knife of FIG. 1 shown with the blade in the open position, as viewed from the bottom and the opposite side of the knife.
Figure 4:
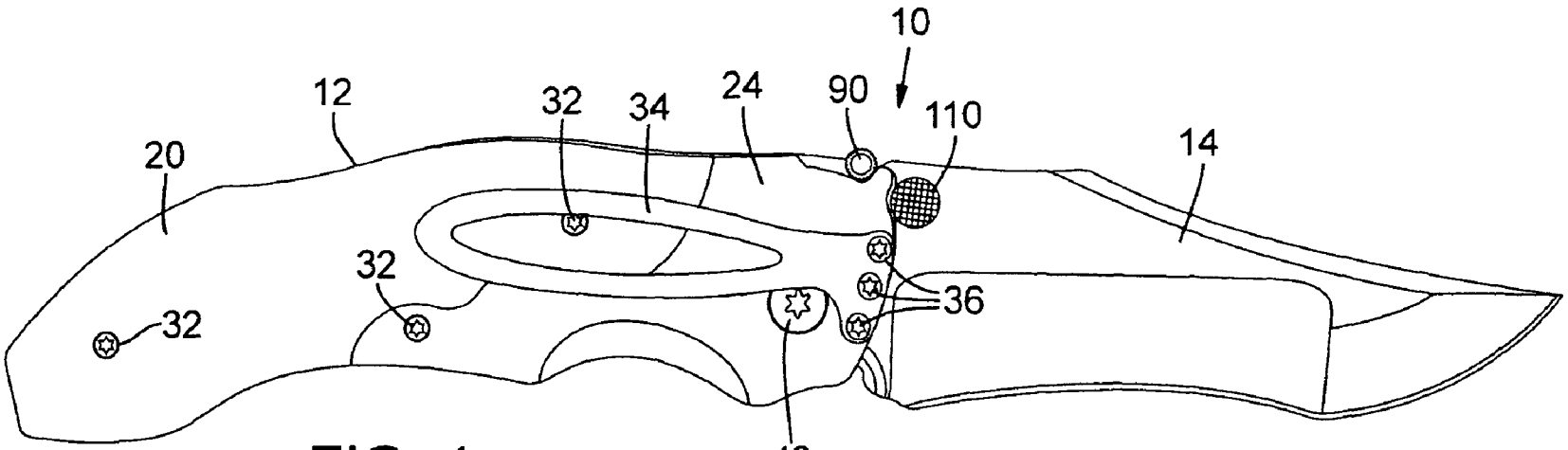
FIG. 4 is a side elevation view of the folding knife of FIG. 1 shown with the blade in the open position.
Figure 5:
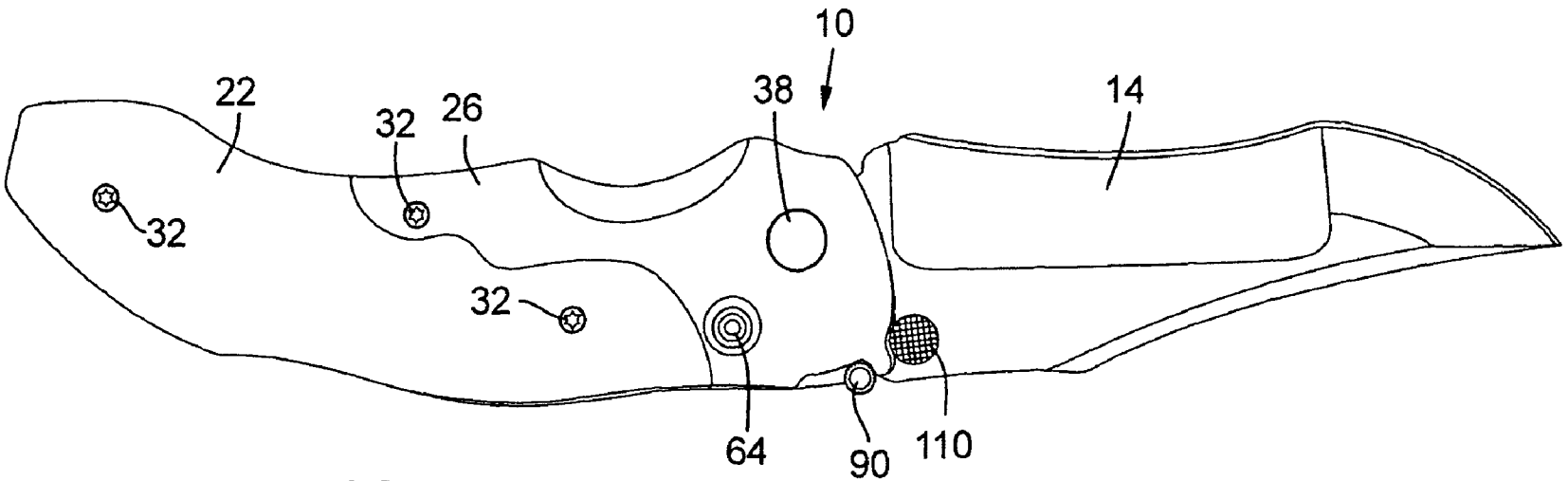
FIG. 5 is another side elevation view of the opposite side of the folding knife from that shown in FIG. 4.
Figure 6:
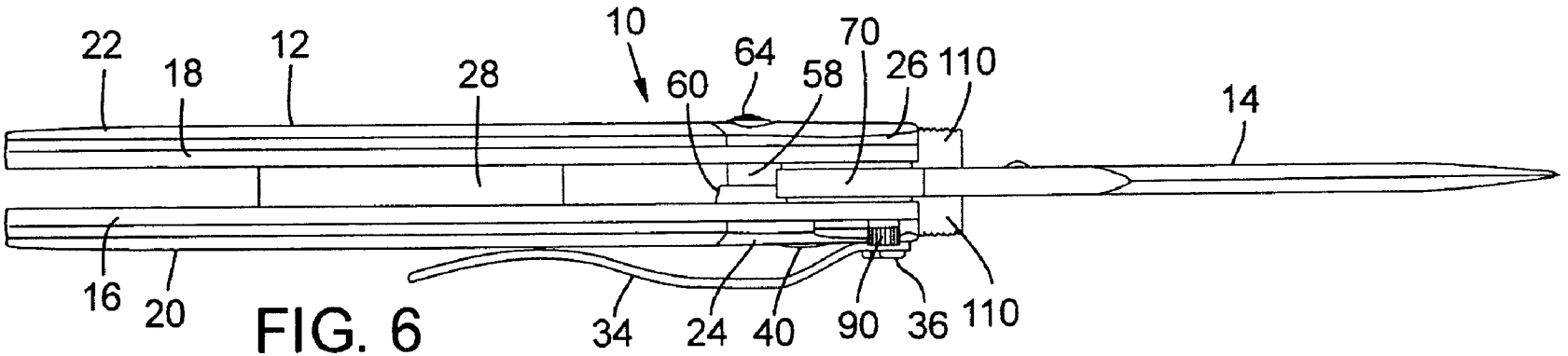
FIG. 6 is a top plan view of the folding knife shown with the blade in the open position.
Figure 7:
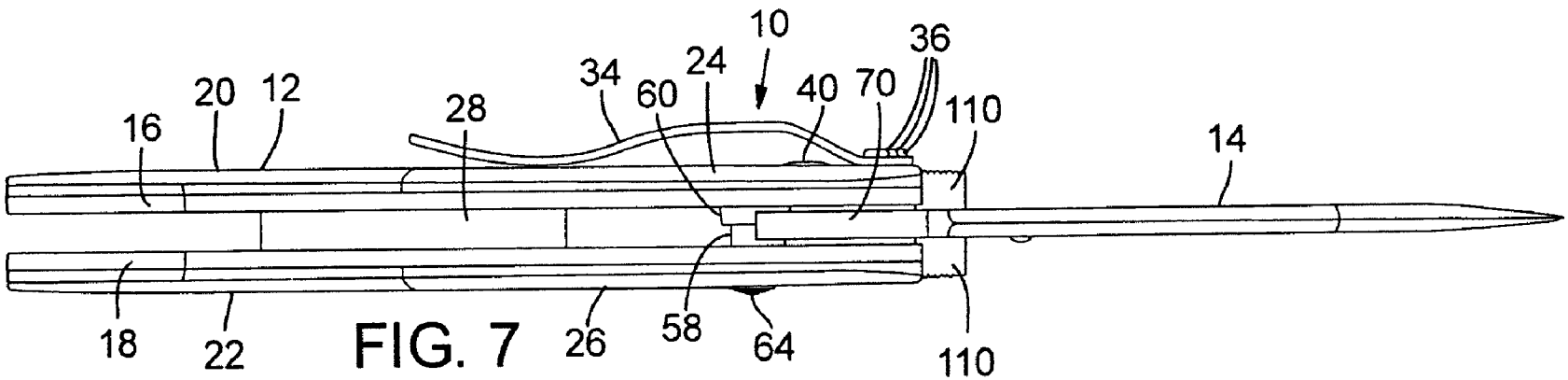
FIG. 7 is a bottom plan view of the folding knife shown with the blade in the open position.

FIGS. 1-8 show an automatic folding knife 10, according to one embodiment, comprising a handle portion, or handle, 12, and a blade 14 pivotably connected to the handle portion 12. The blade 14 can be pivoted between an open position extending from the handle portion for use (FIGS. 2-7) and a closed, or folded, position at least partially received in the handle portion (FIG. 1).

Figure 8:
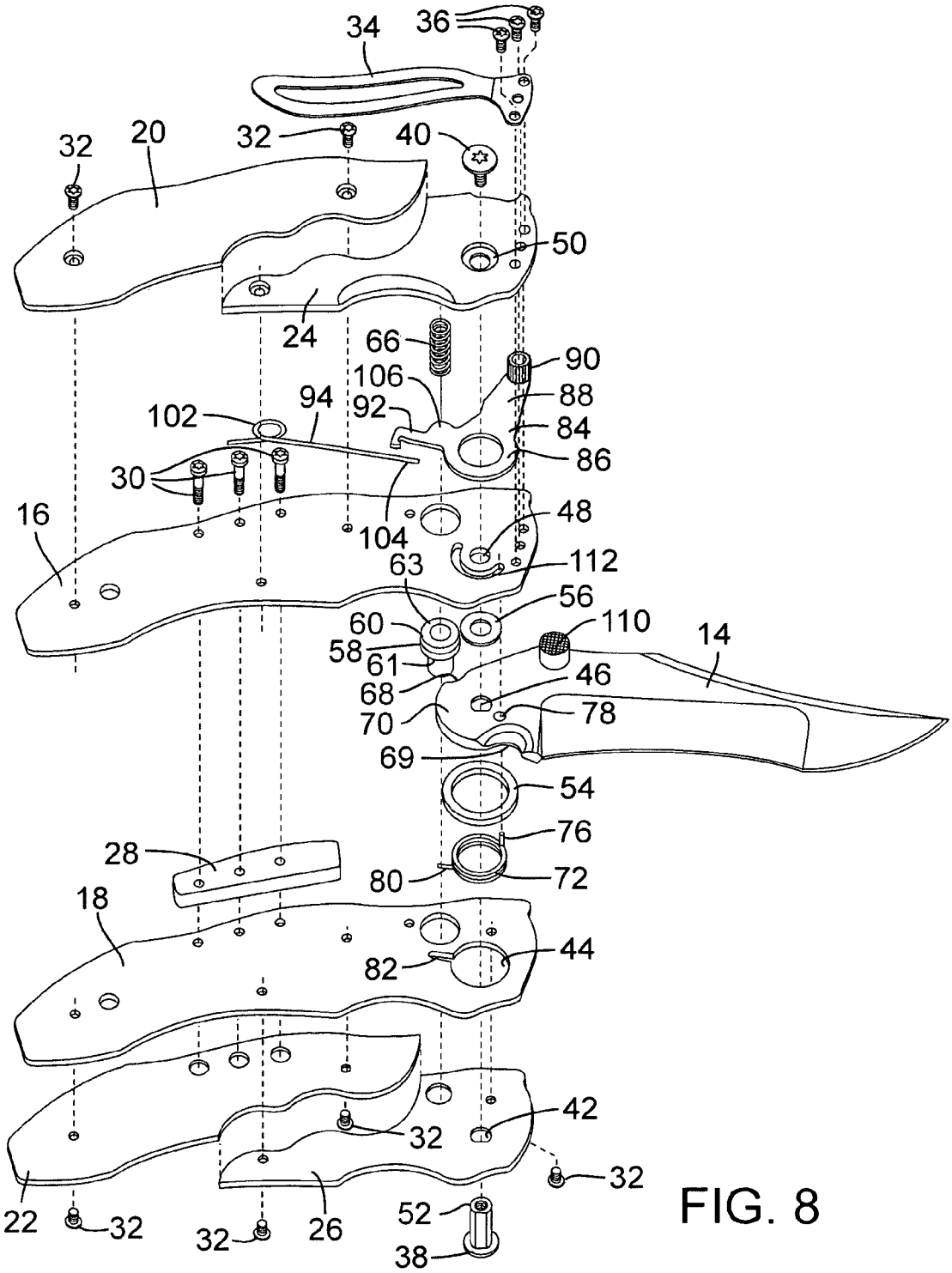
FIG. 8 is a perspective, exploded view of the folding knife of FIG. 1.

As best shown in FIG. 8, the handle portion 12 in the illustrated embodiment comprises first and second inner plates, or liners, 16 and 18, respectively, first and second outer plates 20 and 22, respectively, mounted to the outside surfaces of the inner plates 16, 18, and first and second bolsters 24 and 26, respectively, mounted to the outside surfaces of the inner plates 16, 18 adjacent the blade 14. A spacer/spine portion 28 is positioned between the inner plates 16, 18 along the top edge of the handle portion. The inner plates 16, 18 can be secured to each other and the spacer 28 by screws 30 extending through corresponding openings in the inner plate 16 and the spacer 28 and tightened into corresponding threaded openings in the inner plate 18. The outer plates 20, 22 and the bolsters 24, 26 can be secured to the inner plates 16, 18 by screws 32. If desired, an optional clip 34 can be secured to the handle portion 12, such as by screws 36 securing the clip 34 to the first bolster 24.

The blade 14 can be connected to the handle portion 14 by a pivot mechanism comprising a pivot pin 38 and a pivot screw 40. The pivot pin 38 extends through openings 42, 44, 46, and 48 in the second bolster 26, the inner plate 18, the blade 14, and the inner plate 16, respectively, and through washers 54, 56. The pivot screw 40 extends through an opening 50 in the first bolster 24 and is tightened into a threaded opening 52 in the pivot pin 38. The blade 14 can include a thumb stud 110 on one or both sides of the blade.

Figure 11:
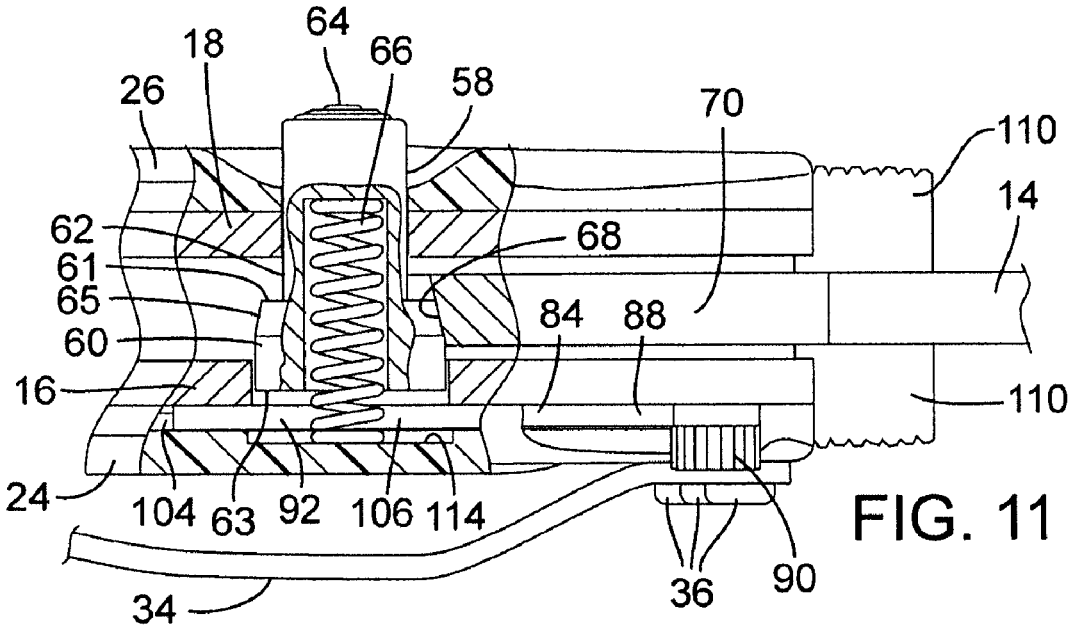
FIG. 11 is an enlarged, fragmentary, partial sectional view of the folding knife of FIG. 1 showing the safety mechanism in the safety position and the cross-bolt in the locked position.
Figure 13:
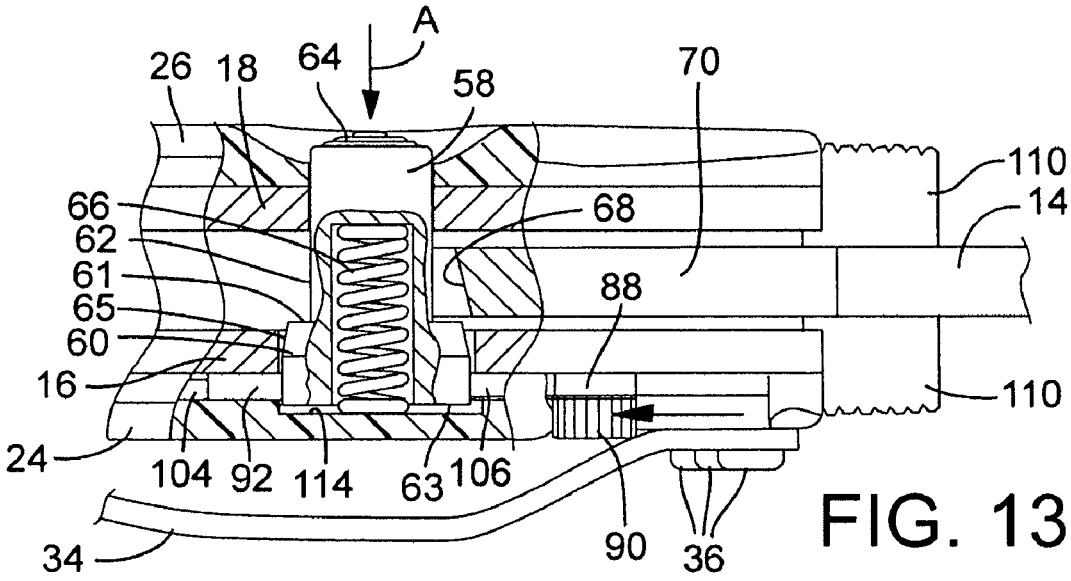
FIG. 13 is an enlarged, fragmentary, partial sectional view of the folding knife of FIG. 1 showing the safety mechanism in the release position and the cross-bolt in the unlocked position.

The knife 10 includes a latch mechanism or blade locking mechanism in the form of a cross-bolt 58 that is operable to lock the blade 14 against pivoting movement when the blade is in the open and closed positions. As best shown in FIGS. 11 and 13, the cross-bolt 58 in the illustrated embodiment comprises an enlarged end portion 60 at one end thereof and an elongated extension portion 62 of a reduced diameter extending from the enlarged end portion 60. The enlarged end portion 60 can be formed with a tapered section 65 that is slightly tapered extending in a direction toward the extension portion 62. The extension portion 62 extends through corresponding openings in the inner plate 18 and the bolster 26 and has an exposed end portion 64 serving as a button for operating the cross-bolt 58. The cross-bolt 58 can be shifted or moved laterally of the handle portion 12 between a locked position (FIG. 11) and an unlocked position (FIG. 13). The extension portion 62 and the end portion 60 can be formed with a bore that receives a spring 66 that resiliently retains the cross-bolt 58 in the locked position shown in FIG. 11.

Figure 15:
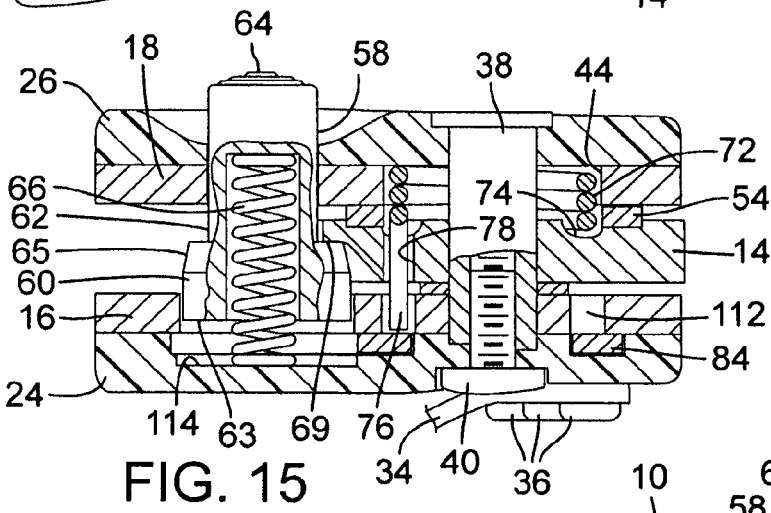
FIG. 15 is a cross-sectional view taken along line 14-14 of FIG. 14.

As shown in FIG. 11, when the cross-bolt 58 is retained in the locked position by the bias of the spring 66 and the blade is in the open position, the tapered section 65 of the enlarged end portion 60 abuts an end surface of a notch 68 of the tang portion 70 of the blade 14 to resist pivoting of the blade 14 to the closed position. As shown in FIG. 13, when the cross-bolt 58 is pushed inwardly in the direction of arrow A to the unlocked position, the end portion 60 clears the notch 68 to permit pivoting of the blade 14. When the blade is in the closed position, the tapered section 65 of the cross-bolt 58 engages a notch 69 in the tang portion 70 of the blade to resist pivoting of the blade to the open position (as best shown in FIG. 15).

Figure 9:
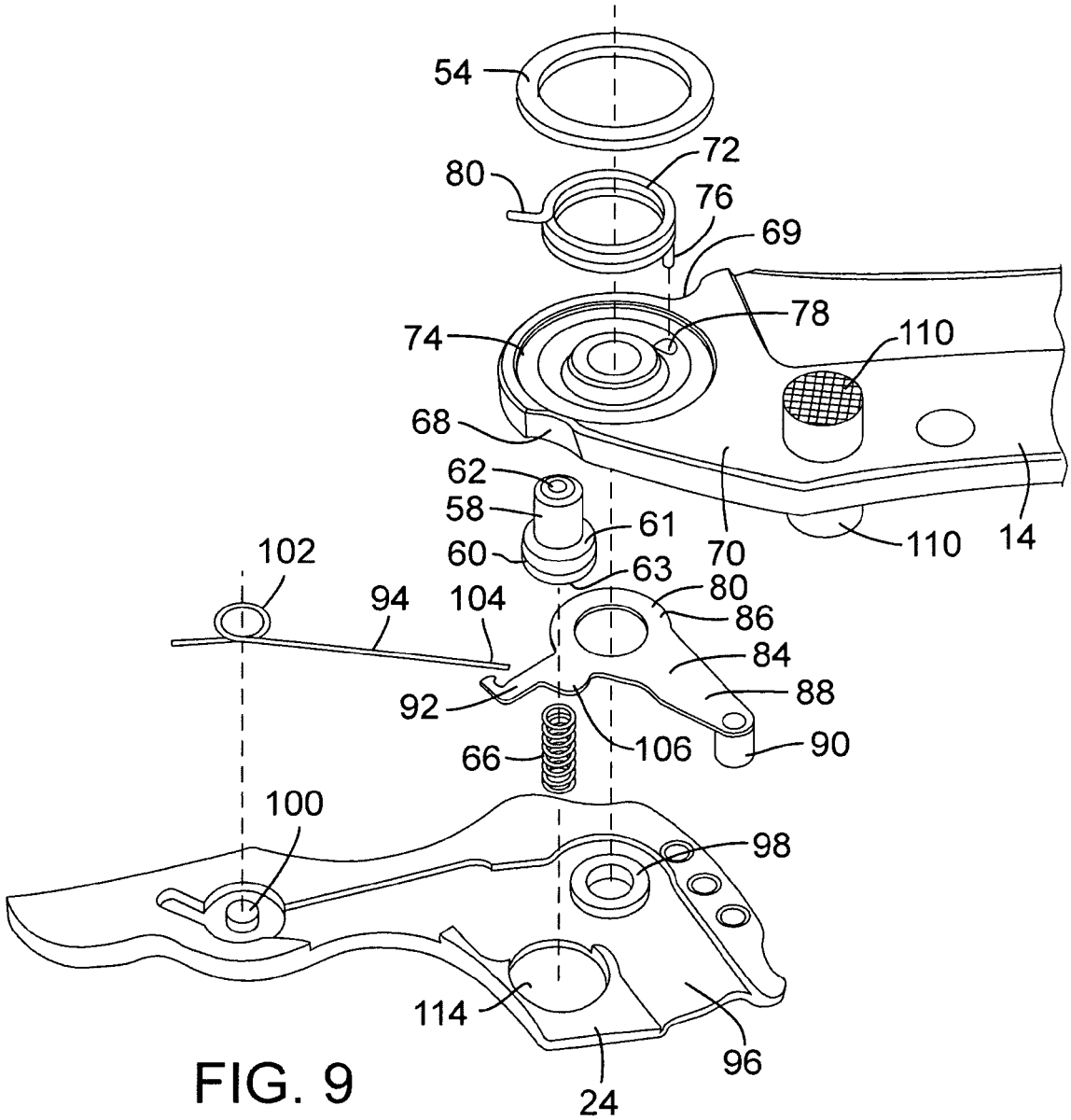
FIG. 9 is an enlarged, fragmentary, exploded view of the blade, safety mechanism and cross-bolt of the folding knife of FIG. 1.

The knife 10 can include a biasing mechanism that is operable to exert a biasing force sufficient to propel the blade 14 from the closed position to the open position upon actuation of the cross-bolt. For example, the biasing mechanism can be a torsion spring 72 operatively connected to the blade and the handle portion. Other biasing mechanisms known in the art can be used to provide an opening force for automatically opening the knife. As best shown in FIGS. 8 and 9, the spring 72 can be disposed in a recess 74 formed in the tang portion 70 of the blade. The spring 72 can be formed with a first end portion 76 that extends into an opening 78 in the tang portion 70 and an arcuate slot 112 in the liner 16 and a second end portion 80 that extends into a slot 82 (FIG. 8) in the inner plate 18. The spring 72 is operable to pivot the blade 14 automatically from the closed position to the open position when the cross-bolt 58 is moved to the unlocked position.

The knife 10 also can be provided with a safety mechanism 84 that is operable to protect against inadvertent movement of the cross-bolt 58 to the unlocked position, thereby preventing the blade 14 from opening or closing. The safety mechanism 84 can have a base 86 formed with an opening through which the pivot pin 38 extends to permit pivoting of the safety mechanism between a safety position and a release position. The safety mechanism 84 can have an extension portion or lever 88 extending from the base 86. The lever 88 has an upper end portion exposed at the top edge of the knife adjacent the tang portion 70 of the blade. The upper end portion can have a stud 90 extending therefrom that is exposed at the top of the knife for manual movement of the safety mechanism by a user. The safety mechanism 84 can also have a rear extension portion 92 that contacts a wire spring 94 that urges the safety mechanism to its safety position.

Figure 12:
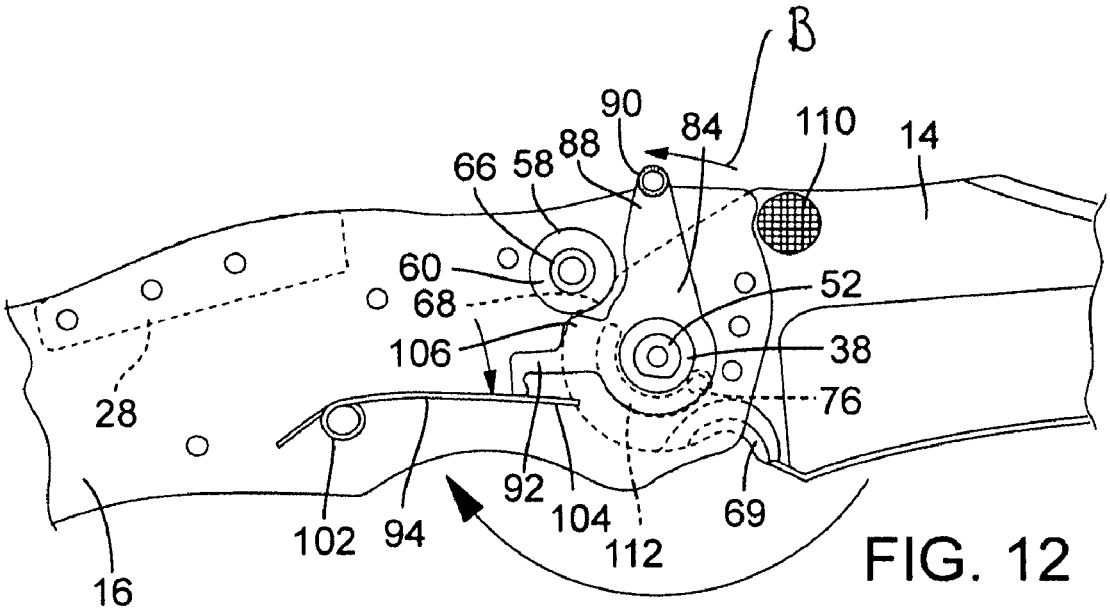
FIG. 12 is a fragmentary side view of the folding knife of FIG. 1 showing the safety mechanism in the release position to allow the knife blade to be pivoted closed.

As best shown in FIG. 9, the bolster 24 can be formed with a recessed portion 96 that receives the safety mechanism 84 and the spring 94. Within the recessed portion 96, the bolster 24 can be formed with a cylindrical projection 98 that extends into the base 86 of the safety mechanism. The bolster 24 can also be formed with another projection 100 that extends into a coil 102 formed in the spring 94 to fix the coil relative to a free end portion 104 of the spring contacting the extension portion 92 of the safety mechanism 84. In this manner, the free end portion 104 bears against the extension portion 92 to urge the safety mechanism 84 to a safety position shown in FIG. 10. The safety mechanism 84 can be moved to a release position shown in FIG. 12 by moving the stud 90 rearwardly against the biasing force of the spring 94 in the direction of arrow B.

Figure 10:
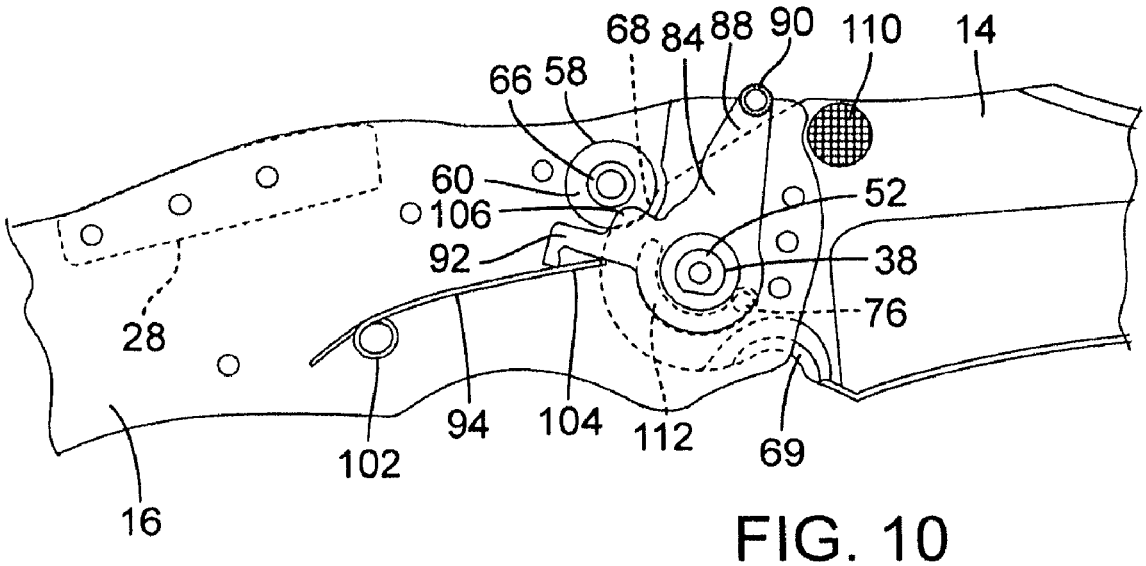
FIG. 10 is a fragmentary, side view of the folding knife of FIG. 1 showing the safety mechanism in the safety position to prevent inadvertent closure of the knife blade.

As further shown in FIG. 9, the inner surface of the bolster 24 can be formed with a recessed portion 114 that receives the end portion 60 of the cross-bolt 58 when the cross-bolt is pressed inwardly to its locked position. When manual pressure is not applied to the cross-bolt, it is resiliently retained in the locked position and the spring 94 moves the safety mechanism to the safety position such that a shoulder portion 106 of the safety mechanism 84 extends into the recessed portion 114. As best shown in FIGS. 10 and 11, the shoulder portion 106, when extending into the recessed portion 114, is positioned in the path of an end surface 63 of the cross-bolt 58 and prevents the end portion 60 of the cross-bolt from being moved to its unlocked position, thereby protecting against inadvertent closure or opening of the blade. To close the blade 14 from its open position, the safety mechanism 84 is moved to its release position shown in FIG. 12, which moves the shoulder portion 106 out of the recessed portion 114 and away from the path of the cross-bolt 58. While holding the safety mechanism 84 in its release position, the cross-bolt 58 can be pushed inwardly to its unlocked position (FIG. 13) to allow the blade 14 to be pivoted from the open position to the closed position.

Figure 14:
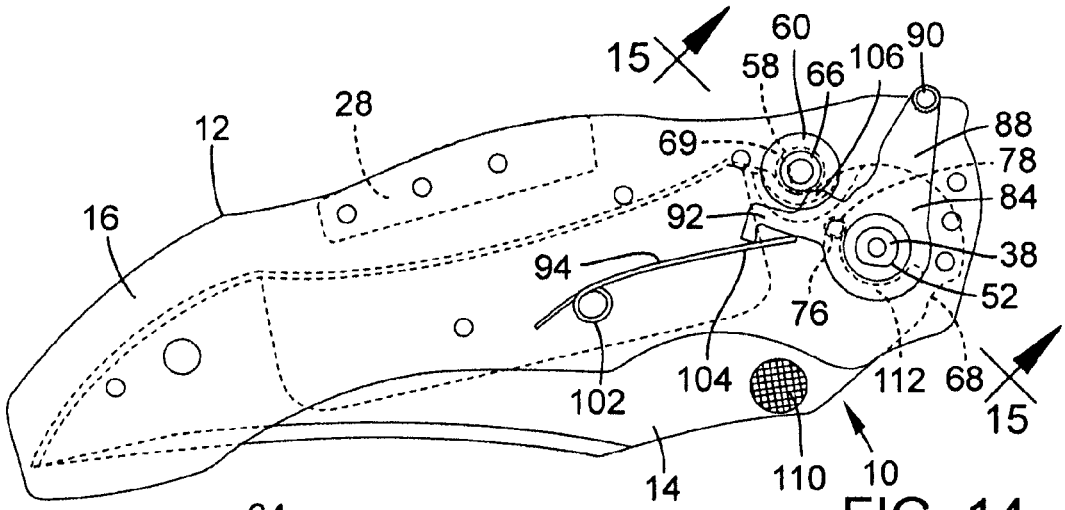
FIG. 14 is a side view of the folding knife of FIG. 1 showing the blade in the closed position and the safety mechanism in the safety position to prevent inadvertent opening of the knife blade.
Figure 16:
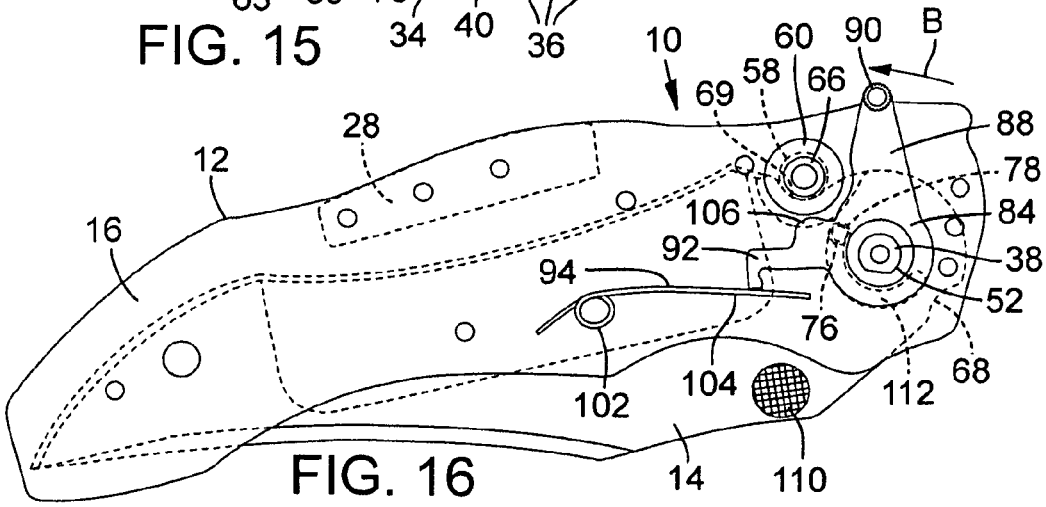
FIG. 16 is a side view of the folding knife of FIG. 1 showing the blade in the closed position and the safety mechanism in the release position to allow the blade to be opened.

Removing manual pressure from the cross-bolt 58 and the safety mechanism 84 when the blade is closed causes the safety mechanism to return to the safety position under the bias of the spring 94 and the cross-bolt to return to its locked position under the bias of the spring 66, thereby locking the blade in the closed position against the opening force of the spring 72. When the blade is closed, the shoulder portion 106 of the safety mechanism 84 again blocks movement of the cross-bolt 58 to its unlocked position to protect against inadvertent opening of the blade, as illustrated in FIG. 14. To open the blade, the user pulls back the safety mechanism 84 (FIG. 16) while pressing the cross-bolt 58 inwardly to its unlocked position, which allows the blade 14 to pivot to the open position under the biasing force of the spring 72.

FIGS. 17-20 show an exemplary embodiment of a manual folding knife 10', which can have the same construction as the knife 10 except that the manual knife 10' is not provided with a spring 72. Thus, in this embodiment, manual pressure is applied to the blade 14 in order to open and close the blade. The knife 10' also can include a motion-limiting member in the form of a flexible spring arm or limiting strap 200 that blocks movement of the cross-bolt 58 to its locked position when the blade is in the closed position, as described in greater detail below.

Figure 17:
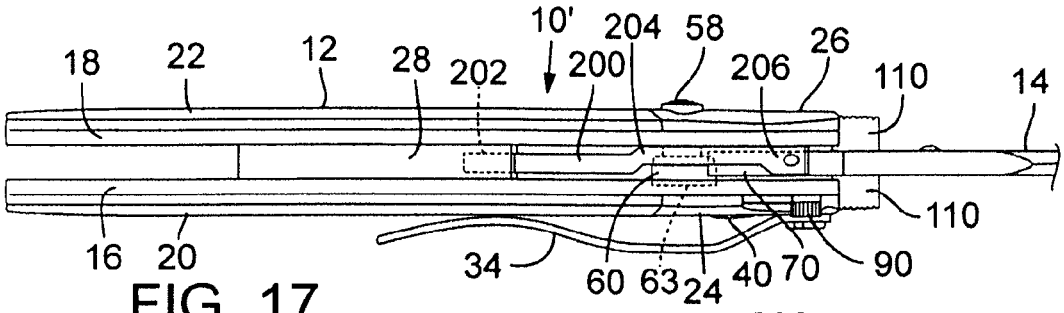
FIG. 17 is a top plan view of an exemplary embodiment of a manual folding knife shown with the blade in the open position.
Figure 19:
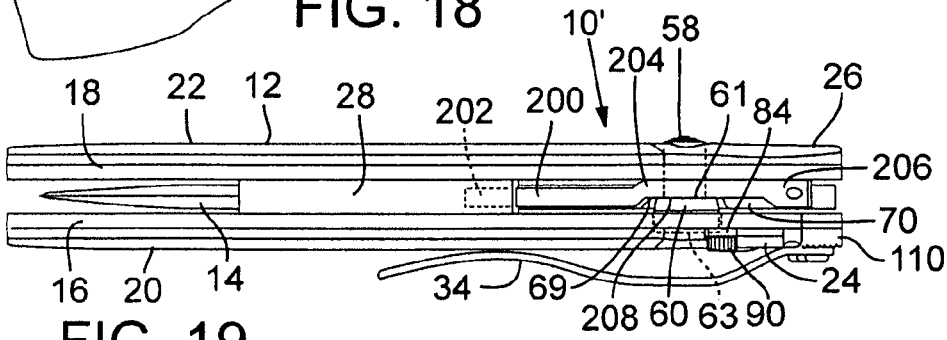
FIG. 19 is a top plan view of the folding knife of FIG. 17 shown with the blade in the closed position.
Figure 20:
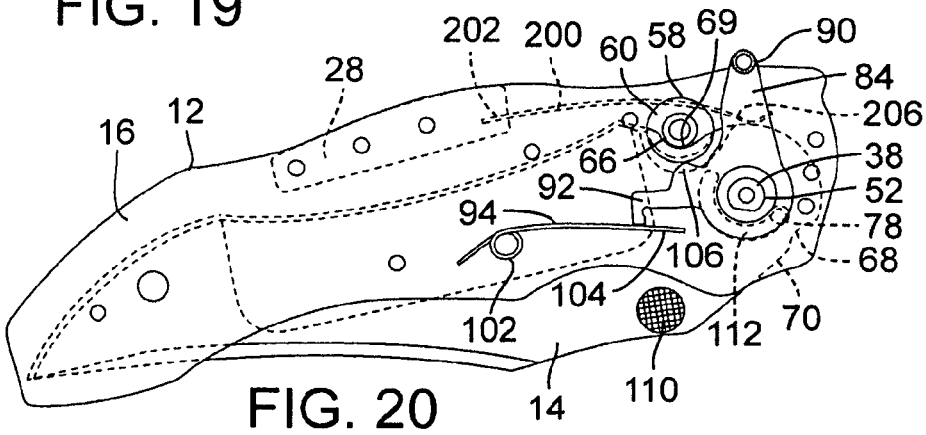
FIG. 20 is a side elevation view of the folding knife of FIG. 17 showing the blade in the closed position.

The spring arm 200 has a fixed end portion 202 that can extend into an opening in the spacer 28 to secure that end portion from moving relative to the handle portion and the blade. As shown in FIGS. 17 and 19, the arm 200 has an offset portion 204 that terminates in a free end portion 206 that can bear against the tang portion 70 of the blade. When the blade 14 is in the closed position, as shown in FIGS. 19 and 20, the offset portion 204 is resiliently retained in a first position in which the offset portion 204 abuts an end surface 61 of the end portion 60 of the cross-bolt 58 and therefore prevents the cross-bolt from moving to its locked position under the force of the spring 66. Consequently, the arm 200 retains the cross-bolt in its unlocked position to prevent positive locking of the blade in the closed position. The blade 14 can be retained against opening under its own weight by the frictional force provided by the pivot pin 38, as in a conventional manual folding knife. Opening the blade can be accomplished by applying manual pressure to the blade, such as to a thumb stud 110 provided on the blade. Unlike the automatic knife 10, the user need not press the cross-bolt or move the safety mechanism 84 to the release position to open the blade, which makes the knife 10' easier to operate. In this manner, the knife 10' functions similar to a conventional manual folding knife when the blade is in the closed position.

Figure 18:
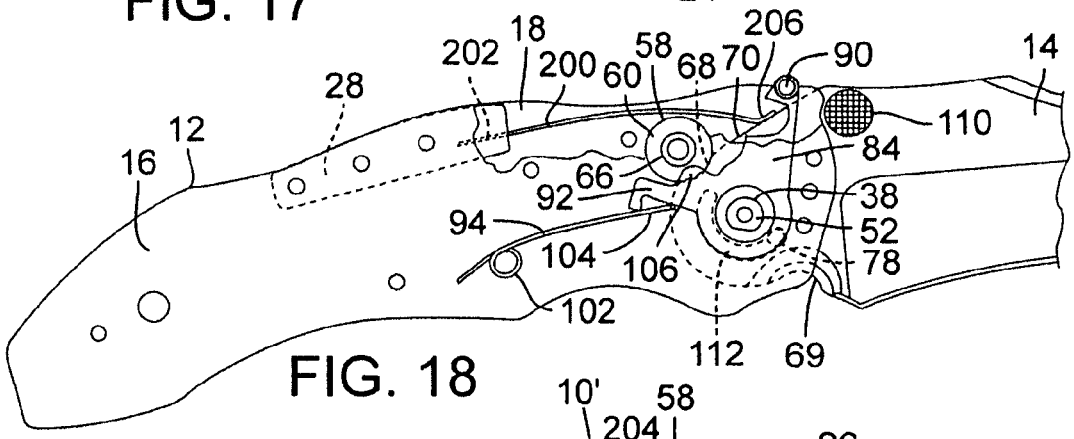
FIG. 18 is a side elevation view of the folding knife of FIG. 17 showing the blade in the open position and the safety mechanism in the safety position to protect against inadvertent closure of the blade.

As the blade is moved from the closed position to the open position, the free end portion 206 of the arm 200 rides on the end surface of the tang portion 70 of the blade. The tang portion 70 functions as a cam, lifting the offset portion 204 to a second position away from the path of the cross-bolt 58, as illustrated in FIGS. 17 and 18. This allows the cross-bolt 58 to move to its locked position engaging the tang portion 70 to resist pivoting movement of the blade back to the closed position. Therefore, when the blade is in the open position, the cross-bolt 58 and the safety mechanism 84 can perform their intended functions as described above in connection with the automatic knife 10. The blade 14 of the knife 10' can be closed in the same manner as the blade of the automatic knife 10; that is, the user moves the safety mechanism 84 rearwardly to its release position while simultaneously pressing the cross-bolt to its unlocked position to permit pivoting movement of the blade.

The manual knife 10' can be converted into an automatic knife 10 by removing the spring arm 200 and installing a spring 72 in the recess 74 (FIG. 9) of the blade. Conversely, the automatic knife 10 can be converted into a manual knife 10' by removing the spring 72, and optionally, installing a spring arm 200 to prevent operation of the cross-bolt 58 when the blade is in the closed position.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A folding knife comprising:

a handle portion having a first side member and a second side member;

a blade, the blade having a tang portion that is pivotably coupled to the handle portion between the first and second side members and operable to pivot between a closed position and an open position;

a cross-bolt disposed in the handle portion and having an operating button exposed at a surface of the first side member of the handle portion, the cross-bolt being moveable between an unlocked position and a locked position to retain the blade in at least the open position, the cross-bolt being moveable in a direction generally perpendicular to a plane formed by the blade;

a safety mechanism having a manually operable exposed portion that extends from a surface of the second side member, the safety mechanism being moveable between a release position and a safety position, wherein when the safety mechanism is in the safety position, it blocks the cross-bolt from moving to the unlocked position, and wherein when the safety mechanism is in the release position, the cross-bolt can be moved to the unlocked position;

a biasing mechanism configured to resiliently urge the safety mechanism to the safety position; and a motion limiting member coupled to the handle portion and configured to restrict movement of the cross-bolt between the unlocked and locked positions, wherein when the blade is in the closed position, the motion limiting member is in a first position that prevents the cross-bolt from moving to its locked position, and pivoting the blade to the open position is effective to move the motion limiting member to a second position that does not prevent the cross-bolt from moving to its locked position, the motion limiting member being movable relative to the blade and cross-bolt.

2. The folding knife of claim 1, wherein the biasing mechanism comprises a wire spring having a fixed end portion and a free end portion, the free end portion resiliently contacting the safety mechanism to urge the safety mechanism into the locked position.

3. The folding knife of claim 2, the wire spring further comprising a coil at the fixed end portion, wherein the coil is disposed around a projection that extends internally from the handle portion of the knife.

4. The folding knife of claim 1, the safety mechanism further comprising a base portion, the base portion having a shoulder portion and the manually operable exposed portion extending therefrom, wherein the manually operable exposed portion comprises a lever portion, and the shoulder portion is configured such that, when the safety mechanism is in the locked position, the shoulder portion extends into a recess in the handle portion and prevents the cross-bolt from being moved into the unlocked position by blocking an end of the cross-bolt from entering the recess.

5. The folding knife of claim 1, wherein when the blade is in the closed position the cross-bolt is moveable to the locked position, and the knife further comprises a second biasing mechanism configured to apply a biasing force to the blade that is effective to open the blade from the closed position when the safety mechanism is moved to the release position and the cross-bolt is moved to the unlocked position.

6. The folding knife of claim 5, wherein the second biasing mechanism is a torsion spring operatively connected to the blade and the handle.

7. A folding knife comprising:

a handle portion;

a blade, the blade having a tang portion that is pivotably coupled to the handle portion and operable to pivot between a closed position and an open position;

a cross-bolt disposed in the handle portion and having an operating button exposed at one side of the handle portion, the cross-bolt being moveable between an unlocked position in which the blade is moveable relative to the handle portion and a locked position in which the blade is restricted from moving relative to the handle portion, the cross-bolt being moveable in a direction generally perpendicular to a plane formed by the blade; and a motion limiting member coupled to the handle and configured to contact the blade such that motion of the blade causes movement of the motion limiting member from a first position that restricts operation of the cross-bolt to a second position that does not restrict operation of the cross-bolt, wherein when the blade is in the closed position, the motion limiting member is in the first position which prevents the cross-bolt from moving to its locked position, and pivoting the blade to the open position is effective to move the motion limiting member to the second position which does not prevent the cross-bolt from moving to its locked position, the motion limiting member being movable relative to the blade and cross-bolt.

8. The folding knife of claim 7, the motion limiting member comprising an end portion that is resiliently biased against the tang portion of the blade, wherein the end portion slidably contacts the tang portion when the blade is moved from the closed position to the open position.

9. The folding knife of claim 8, the motion limiting member further comprising a spring arm having a fixed portion, a blocking portion, and the end portion, the end portion being resiliently biased against an end surface of the tang portion of the blade and the fixed portion being fixed to the handle portion to prevent relative motion between the fixed portion and the handle portion, and the blocking portion restricting movement of the cross-bolt to the locked position when the motion limiting member is in the first position.

10. The folding knife of claim 9, wherein the handle portion comprises two opposing plates with a spacer secured therebetween, and wherein the fixed portion of the spring arm is fixedly attached to the spacer.

11. The folding knife of claim 7, further comprising a safety mechanism moveable between a release position and a safety position, the safety mechanism comprising a biasing mechanism configured to resiliently urge the safety mechanism to the safety position, wherein when the safety mechanism is in the safety position, it blocks the cross-bolt from moving to the unlocked position, and wherein when the safety mechanism is in the release position, the cross-bolt can be moved to the unlocked position.

12. The folding knife of claim 11, wherein the biasing mechanism comprises a wire spring having a fixed end portion and a free end portion, the free end portion resiliently contacting the safety mechanism to urge the safety mechanism into the locked position.

13. The folding knife of claim 12, the safety mechanism further comprising a base portion, the base portion having a shoulder portion and a lever portion extending therefrom, wherein the lever portion has a manually operable exposed member and the shoulder portion is configured such that, when the safety mechanism is in the locked position, the shoulder portion extends into a recess in the handle portion and prevents the cross-bolt from being moved into the unlocked position by blocking an end of the cross-bolt from entering the recess.

14. The folding knife of claim 13, wherein the manually operable exposed member is located towards an end of the handle portion where the tang of the blade is pivotably coupled to the handle portion, and the manually operable exposed member is located on a side of the handle portion that is opposite to the side on which the operating button is located.

* * * * *